United States Patent [19]

Scott

[11] 3,969,846

[45] July 20, 1976

[54] DOOR HINGE

[76] Inventor: Delbert Scott, 594 Ripley, Akron, Ohio 44312

[22] Filed: Oct. 23, 1974

[21] Appl. No.: 517,323

[52] U.S. Cl. ..... 49/504; 16/135
[51] Int. Cl.[2] ..... E06B 1/04
[58] Field of Search ..... 16/135; 49/399–401, 49/501, 504

[56] References Cited

UNITED STATES PATENTS

| | | | |
|---|---|---|---|
| 1,893,450 | 1/1933 | Shively | 49/400 X |
| 2,454,523 | 11/1948 | Philip | 49/504 X |
| 3,710,416 | 1/1973 | Phelps | 16/135 |

*Primary Examiner*—Kenneth Downey
*Attorney, Agent, or Firm*—Joseph Januszkiewicz

[57] ABSTRACT

A door hinge having two leafs with one leaf attachable to a door and the other leaf having two non-coplanar portions interconnected by an off-set portion. Each non-coplanar portion has bores for securing it to the studding. One of such portions is exposed while the other of such portions is covered by dry wall or plaster board.

1 Claim, 3 Drawing Figures

DOOR HINGE

BACKGROUND OF THE INVENTION

This invention relates generally to hinges and more particularly to door hinges.

The conventional butt or door hinge comprises two hinge leaves or butts which are provided with axially aligned interfitting hinge eyes for removably receiving a hinge pin which holds the two leaves together in a secure manner allowing the one leaf (which supports a door) to swing smoothly and freely relative to the other leaf which must be securely fastened to a stable non-movable support such as a studding for a door frame.

In the conventional installation of a door, the framing structure included the use of a door jam, casings and stop which installation thus includes expensive lumber, as well as expensive carpentry time. The present invention is directed to reducing the amount of expensive labor involved in hinge installation by modifying the hinge structure, additionally reducing the expensive lumber required in such installation and can rely directly on the dry wall material which is considerably less expensive. In considering the number of doors installed in a new house, the elimination of the casing and door jam material alone represents a sizable contribution to the reduction of cost. Further, the door hinge structure of the present invention considerably facilitates the repair work, in and around the door framework. In addition, such door hinge provides superior means for maintaining the hinge in fixed position while permitting a degree of adjustability heretofore not available.

SUMMARY OF THE INVENTION

The present invention utilizes a novel hinge structure wherein one leaf is secured to a door in the conventional manner, while the other leaf, which is interconnected to the first leaf by conventional eyes and pin. The other leaf has two non-coplanar portions, with one portion secured directly to the studding while the other portion of the other leaf has plaster board or dry wall construction material located between it and the studding. After attachment of such hinge to the studding, dry wall or plaster board overlays a portion of the hinge providing an aesthetic looking construction without the expensive door jam or casing material.

DETAILED DESCRIPTION

Figure 1:
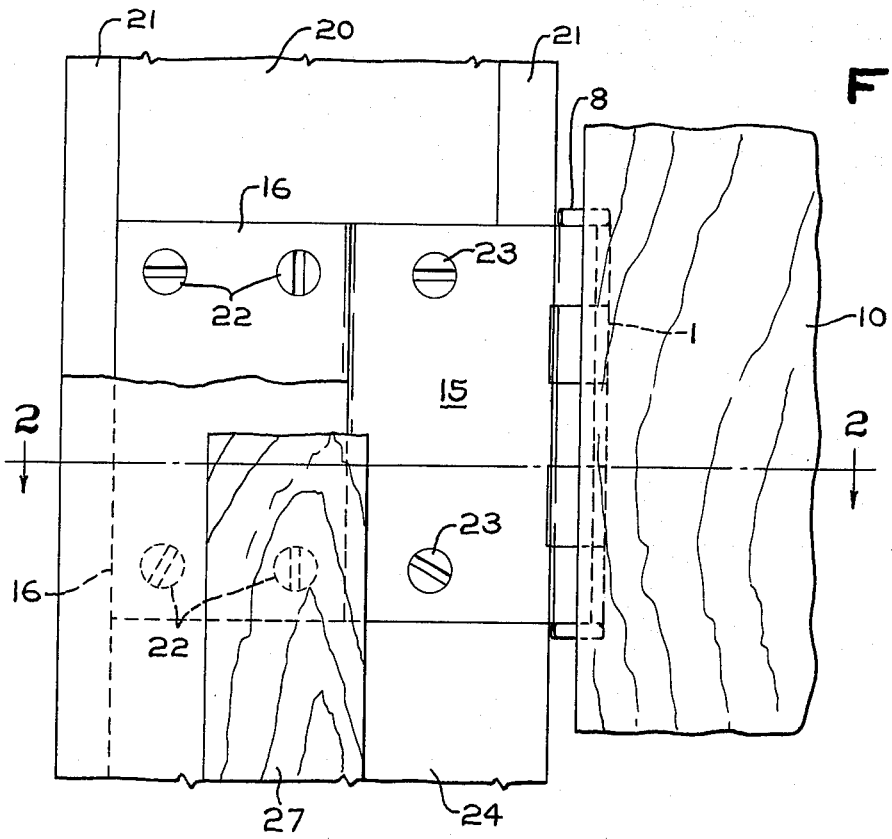
FIG. 1 is a front elevational view of a door hinge of the preferred embodiment attached to studding and a door with a dry wall and door stop broken away.
Figure 3:
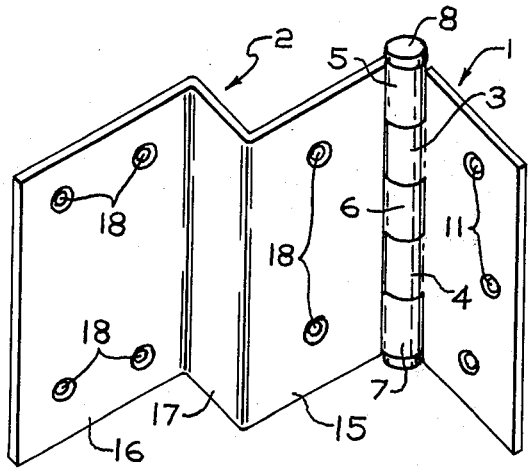
FIG. 3 is a perspective view of the door hinge.

Referring to the drawings wherein like reference characters designate like or corresponding parts throughout the several views, there is shown in FIGS. 1 and 3 a butt hinge comprising two hinge leaves 1 and 2 which are provided with axially aligned interfitting hinge eyes 3, 4, and 5, 6, 7 of substantially uniform internal diameter to slidably receive a hinge pin 8 of conventional construction. Hinge leaf 1 which attaches to the door 10 has a plurality of bores 11 for receiving screws 12 to securely fasten such leaf 1 to the door.

Figure 2:
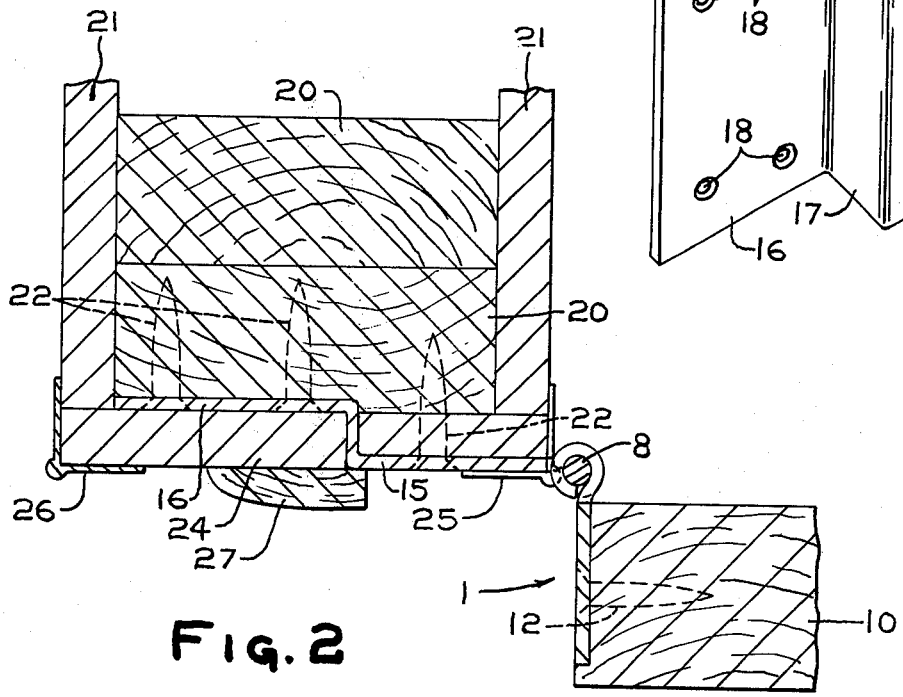
FIG. 2 is a plan view of the hinge door assembly taken on lines 2—2 of FIG. 1.

Leaf 2 is of a step construction having a first flat portion 15 from which the hinge eyes 5, 6, and 7 extend and a second flat portion 16 interconnected to the first portion by a narrow width portion 17. Flat portions 15 and 16 are parallel to each other while portion 17 extends at right angles to them. Portion 17 acts as an off-set portion between non-coplanar portions 15 and 16. Off-set portion 17 provides an abrupt change in direction to the hinge leaf portion 15 relative to portion 16 for a purpose to be described. Portions 15 and 16 of leaf 2 have a plurality of spaced bores 18 extending therethrough for receiving screws 20 for attaching the hinge leaf 2 to the stationary structure. Such hinge is installed directly to the conventional vertical studding indicated as 20 in FIGS. 1 and 2. The studding 20 has plaster board 21 or dry wall 21 attached thereto and extending as walls of a room and terminating at the studding. The hinge is then aligned into position on the stud 20 and secured thereto by suitably screws 22 attaching the second portion 16 of hinge leaf 2 to the stud. As shown, the stud is recessed to make the outeredge of the second portion flush with the outersurface thereof. A small section of plaster board, the dimension of the leaf portion 15 is mounted between the first portion 15 of hinge leaf 2 and the stud 20 by fastening screws 23 through bore 18. A strip of plaster board 24 is then secured to the studding 20, overlapping the open edges of the two sections of plaster board 21—21. Bead edges 25, 26 only shown in FIG. 2, are secured to the respective corners of the plaster board or dry wall construction to permit the application of finishing plaster to the edges thereof to complete the installation. It will be noted that this installation, that the door jam generally used in door installations has been eliminated and that only a door stop 27 need be installed. In a similar manner, door casings have been eliminated thereby additionally reducing quality lumber necessary for door installations as well as carpentry time. Since the plaster board or dry wall behind the first portion of hinge leaf 2 is crushable, it may form a suitable means for adjusting the overall hinge position by the tightening of the screws associated therewith.

It will be apparent that although a specific embodiment of the invention has been described in detail, the invention is not limited to the specifically illustrated and described constructions since variations may be made without departing from the principles of the invention.

I claim:

1. A door assembly comprising a hinge member having a pair of leafs, one of said leafs attached to a door, the other of said leafs having a first planar portion and a second planar portion spaced from but parallel to said first portion, an interconnecting portion connecting said first portion to said second portion, bores in each of said first and second portions for receiving screws for attaching said other leaf to a door framing stud, said screws of said first portion and said second portion having their central longitudinal axes parallel to each other, hinge means interconnecting said leafs, a plaster board member interposed between said first portion and said stud, plaster board means secured to said stud and overlaying said second portion of said other hinge leaf, and an elongated door stop attached to said plaster board means.

* * * * *